US008910314B2

(12) United States Patent
Hefter et al.

(10) Patent No.: US 8,910,314 B2
(45) Date of Patent: Dec. 16, 2014

(54) POCKET SECURITY BLANKET CONSTRUCTION

(76) Inventors: Marni Hefter, East Quogue, NY (US); Jason Hefter, East Quogue, NY (US)

( * ) Notice: Subject to any disclaimer, the term of this patent is extended or adjusted under 35 U.S.C. 154(b) by 37 days.

(21) Appl. No.: 13/238,063

(22) Filed: Sep. 21, 2011

(65) Prior Publication Data

US 2013/0067627 A1 Mar. 21, 2013

(51) Int. Cl.

*A41B 15/00* (2006.01)
*A41D 27/20* (2006.01)
*A41D 11/00* (2006.01)

(52) U.S. Cl.

CPC ..... *A41D 11/00* (2013.01); *A41D 27/20* (2013.01)
USPC ..... 2/69; 2/247; 2/79; 2/93

(58) Field of Classification Search

USPC ..... 2/69, 75, 50, 247, 122, 158, 227, 244, 2/250, 115

See application file for complete search history.

(56) References Cited

U.S. PATENT DOCUMENTS

| | | | | | |
|---|---|---|---|---|---|
| 581,419 | A * | 4/1897 | Hamer | 2/227 |
| 1,417,860 | A * | 5/1922 | Reich | 446/327 |
| 3,308,479 | A * | 3/1967 | Sesco, Jr. | 2/50 |
| 3,447,165 | A * | 6/1969 | Brosk | 2/75 |
| 3,789,546 | A * | 2/1974 | Morrison | 446/327 |
| 3,864,871 | A * | 2/1975 | Kaelin | 446/327 |
| 4,138,745 | A * | 2/1979 | Greenspan | 2/247 |
| 4,504,240 | A * | 3/1985 | Thomas | 446/100 |
| 4,590,633 | A * | 5/1986 | Pickens | 5/482 |
| 4,667,344 | A * | 5/1987 | Cooper, III | 2/79 |
| 4,750,225 | A * | 6/1988 | Simons et al. | 5/485 |
| 4,980,929 | A * | 1/1991 | Long | 2/125 |
| 5,035,007 | A * | 7/1991 | Grilliot et al. | 2/227 |
| 5,117,507 | A * | 6/1992 | Long | 2/158 |
| 5,210,881 | A * | 5/1993 | Stocker et al. | 2/247 |
| 5,516,321 | A * | 5/1996 | Kornbleuth | 446/28 |
| 5,727,489 | A * | 3/1998 | Braverman | 112/475.04 |
| 5,784,718 | A * | 7/1998 | Finnegan | 2/90 |
| 5,901,372 | A * | 5/1999 | Lawler | 2/69 |
| 5,933,866 | A * | 8/1999 | Fox | 2/115 |
| 6,126,507 | A * | 10/2000 | Lieberman | 446/327 |
| 6,233,763 | B1 * | 5/2001 | Spaan | 5/485 |
| 6,427,267 | B1 * | 8/2002 | Turner | 5/482 |
| 6,769,139 | B1 * | 8/2004 | Goldkind | 2/247 |
| 6,805,607 | B2 * | 10/2004 | Hidalgo | 446/369 |
| 7,003,810 | B2 * | 2/2006 | Goldkind | 2/227 |
| 7,231,671 | B2 * | 6/2007 | Allen | 2/227 |
| 7,434,271 | B2 * | 10/2008 | Klayman-Grodsky | 2/244 |
| 7,774,859 | B2 * | 8/2010 | Murray et al. | 2/69 |
| 7,832,022 | B1 * | 11/2010 | Peters | 2/227 |
| 8,181,274 | B1 * | 5/2012 | Prince et al. | 2/115 |
| 2003/0224692 | A1 * | 12/2003 | Hidalgo | 446/369 |
| 2005/0278821 | A1 * | 12/2005 | Klayman-Grodsky | 2/69 |
| 2008/0109930 | A1 * | 5/2008 | Murray et al. | 2/69 |
| 2010/0170026 | A1 * | 7/2010 | Jeffords | 2/227 |
| 2010/0325781 | A1 * | 12/2010 | Lopes | 2/250 |

* cited by examiner

*Primary Examiner* — Richale Quinn
(74) *Attorney, Agent, or Firm* — Ladas & Parry LLP

(57) ABSTRACT

A garment with an integral deployable security blanket formed in a reversible pocket, the garment having at least one garment wall adapted to support the reversible pocket; said reversible pocket having opposed pocket walls secured about peripheral edges leaving an accessible pocket opening; an edge portion of the reversible pocket being graspable to invert the pocket for deployment exteriorly of the garment wall; the pocket walls being formed of tactile material having a first distinctive feel; the graspable edge portion being formed of a tactile material having a second distinctive feel distinguishable by touch from that of said first distinctive feel.

7 Claims, 8 Drawing Sheets

POCKET SECURITY BLANKET CONSTRUCTION

BACKGROUND OF THE INVENTION

The present invention relates to security structures known generally to parents and child caregivers as "security blankets" or "blankies" integrated into articles of clothing. Specifically, "security blankets" are articles known to, carried by, and fondled by children (and some adults) for their particular characteristics such as textures, shapes, colors, and/or scents, and include dolls or toys as well as the more common blanket, the physical, manual contact with which "security blanket" provides comfort and a sense of security to the user. The new and improved security structure of the present invention is directly incorporated into a pocket of a garment which may be reversed to expose the security structure—"blankie." The reversed or inverted pocket will have tactile and/or visual characteristics comparable to those found in "security blankets" or "blankies," namely a familiar look or feel, and, in some cases, scent. In an alternative embodiment, the structure may be in the form of a hand puppet or plaything.

SUMMARY OF THE INVENTION

The primary object of the invention is to provide a garment which has been provided with an integrated "blankie-like" security structure or plaything in a pocket of the garment.

In its simplest and most fundamental form, the pocket security structure is comprised of panels of comfortable, soothing fabric having a texture and tactile feeling duplicative of a security blanket or security toy. Thus, a child might find the security of touching his or her security blanket or security toy by simply reaching into a pocket constructed of comfortable and soothing security blanket/toy fabric. Further incorporation of a familiar security image or pattern on the panels will enhance the derivable security feeling of the child when the pocket is deployed by reversing it to expose both the familiar comforting imagery and/or the comforting tactile feeling of the security fabric.

In an alternative embodiment, the pocket structure is shaped as a plaything and supplemented by one or more plaything elements to give the reversed pocket a toy or doll shape. The toy or doll shape provided by the reversed pocket, in a further embodiment, may be accessed through a separate garment opening as a hand puppet.

For a better appreciation of the multiple advantages of the new and improved pocket security blanket invention, reference should be made to the following detailed description taken in conjunction with the accompanying drawings.

DESCRIPTION OF THE INVENTION

Figure 1:
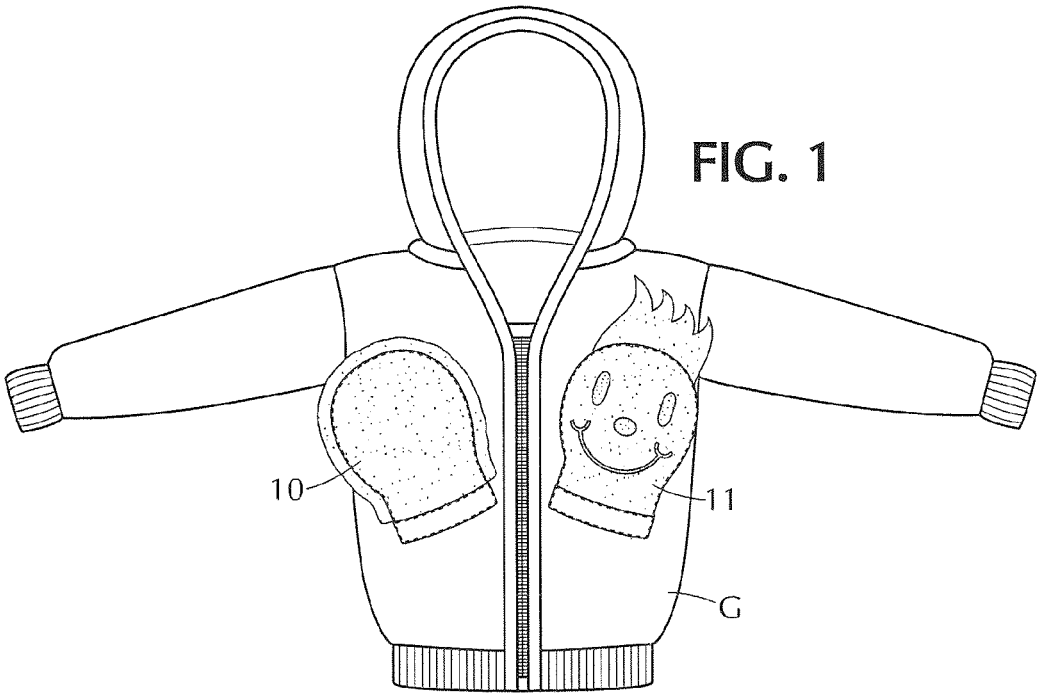
FIG. 1 is a perspective view of a sweatshirt incorporating the integral security blanket construction of the invention with first and second "security blankets" deployed by reversing the pockets.
Figure 2:
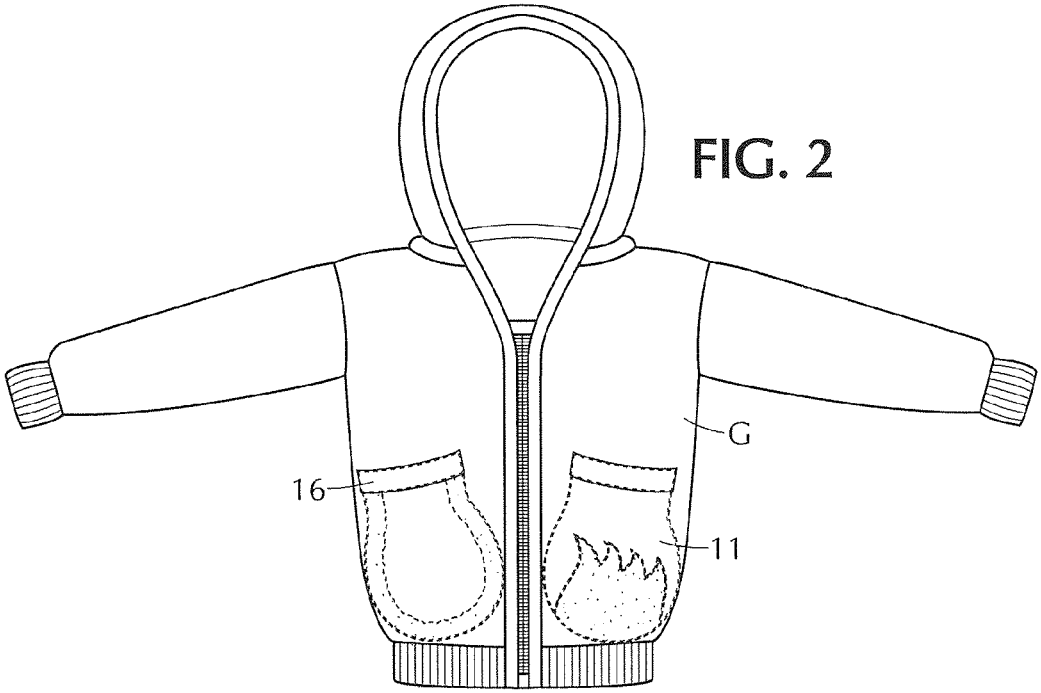
FIG. 2 is a schematic perspective view of the sweatshirt of FIG. 1 with the first and second pockets in non-reversed status.
Figure 3:
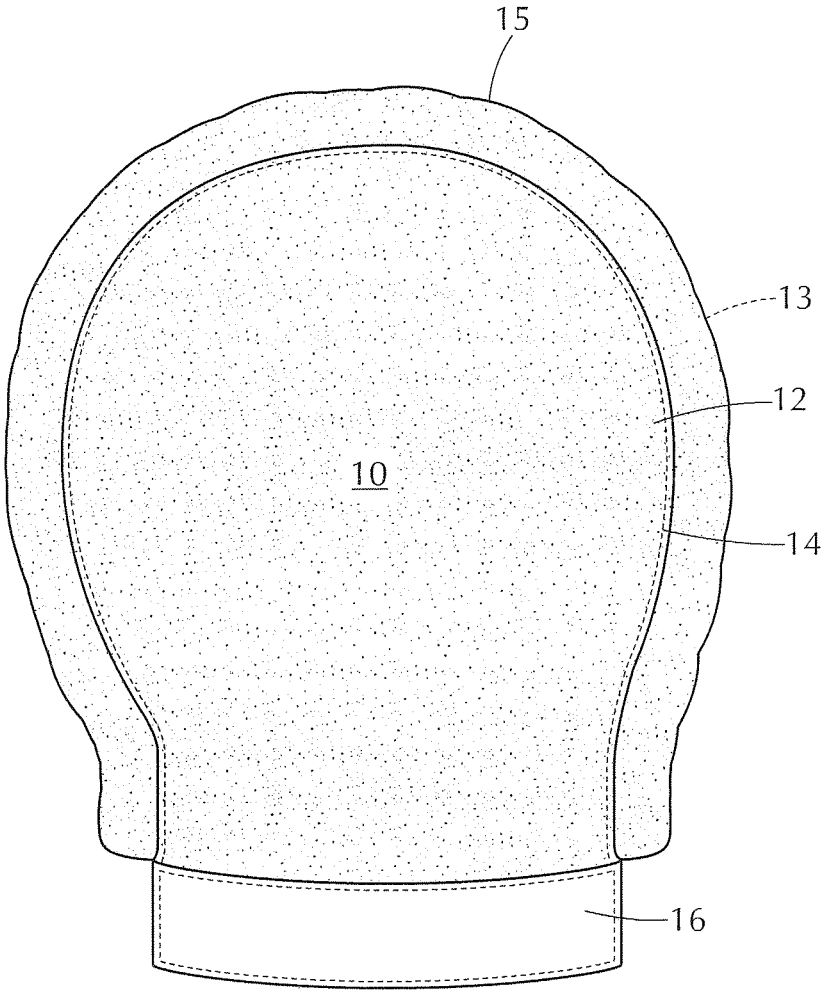
FIG. 3 is a schematic exterior view of a preferred embodiment of a first reversible security blanket pocket of the invention.
Figure 4:
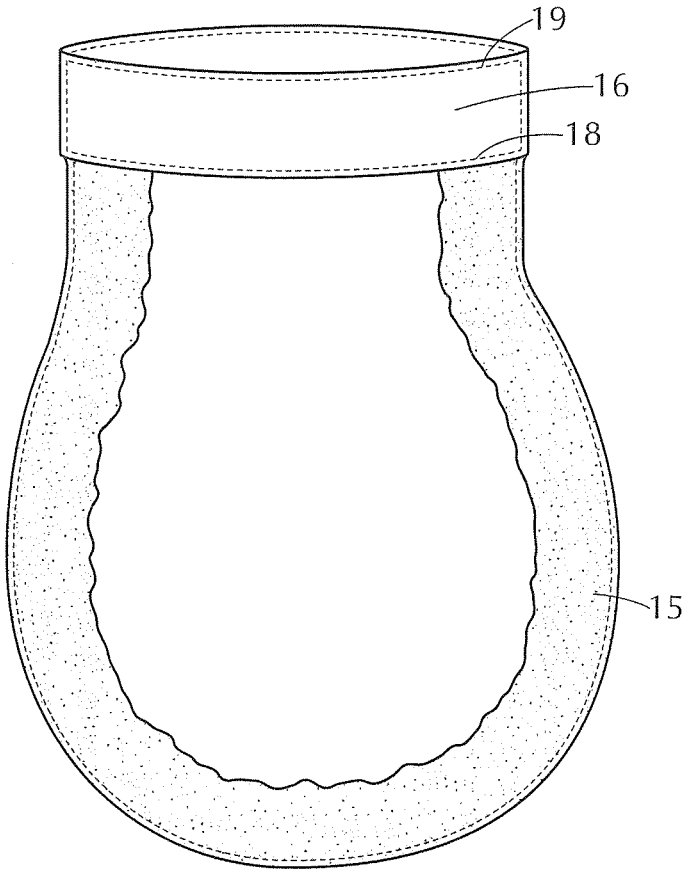
FIG. 4 is a schematic interior view of a preferred embodiment of a first reversible security blanket pocket of the invention.
Figure 5:
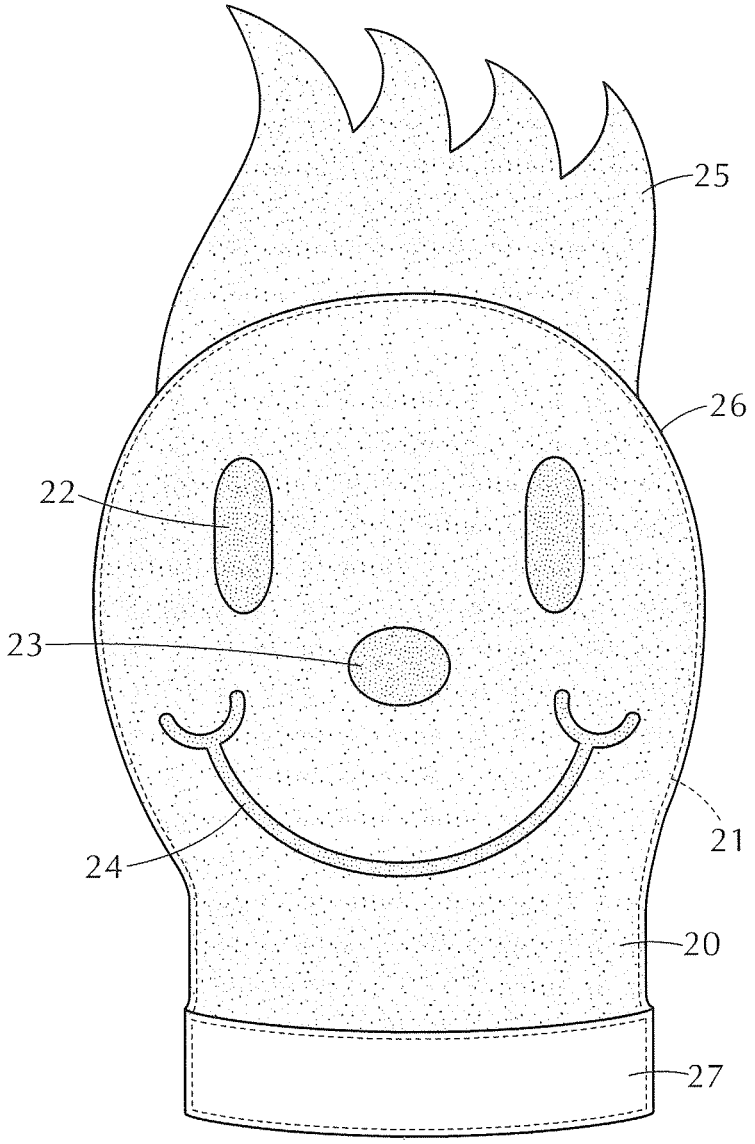
FIG. 5 is a schematic exterior view of a preferred embodiment of a second reversible security blanket pocket of the invention.
Figure 6:
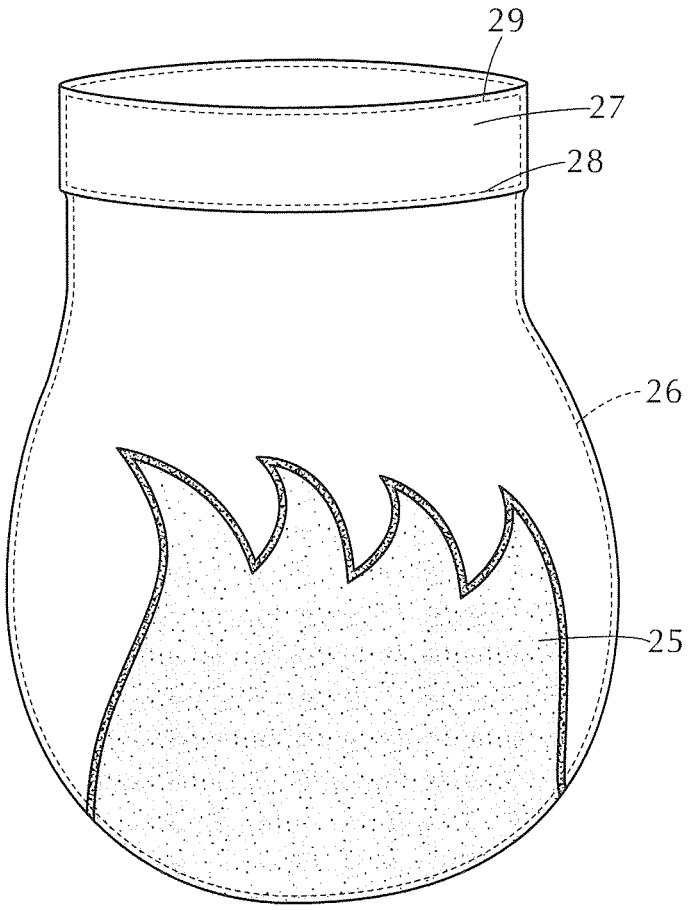
FIG. 6 is a schematic interior view of a preferred embodiment of a second reversible security blanket pocket of the invention.

Referring now to FIGS. 1 and 2, the integral security blanket construction of the invention may be formed as reversible pocket 10 in the form of a "mini-blanket" or reversible pocket 11 in the form of a mini-toy or mini-toy head which is incorporated into a garment G. FIG. 2 illustrates the pocket in normal condition with the opposed pocket walls 12, 13 and 14, 15 disposed within the garment G (shown as a hooded sweatshirt for the purpose of illustration but any garment whatever which includes pockets such as, for example, shorts, trousers and vests may include the invention).

In accordance with the principles of the invention, the pocket 10 is formed from opposed panels or pocket walls 12, 13 having a very particular and distinctive recognizable tactile quality or feel provided by the inherent nature of the particular material chosen, e.g., terry cloth, velour, plush, silk, satin, mohair, cashmere or the like. The opposed panels (which may be formed by a single sheet folded in two) are attached by a generally U-shaped line of stitching 14 extending about the periphery of the panels 12, 13. Advantageously, a folded U-shaped trim strip 15 of contrasting tactile material may be attached to the edges of the panels 12, 13 by the stitching 15 providing a pull-tab for inverting the pocket 10 from its internal position in FIG. 2 to its deployed position in FIG. 1. A child user may obtain the comfort of the security blanket by simply inserting her hand into the pocket or by reversing the pocket to expose the mini-blankie. As a more specific aspect of the invention, the panels may have a predetermined color or design similar to that of a full-sized blankie. Additionally, the one or more of the panels 12, 13 may be impregnated with a predetermined soothing aromatic scent (vanilla, spice, evergreen, or the like) to provide a further degree of comfort.

The pocket 10 is attached to the garment G by any suitable means such as a circumscribing collar 16 fastened both to the top of the pocket 10 by stitching 18 and to an opening 17 in the garment G by stitching 19.

An alternative form of the mini-blankie 10 is a toy head 11 shown in FIGS. 1, 2, 5 and 6. In this form of the invention, the opposed pocket panels 20, 21 are of tactile fabric, e.g., terry cloth, and are shaped to generally represent a head. The panel 20 is provided with eye, nose and mouth graphics 22, 23, 24 by embroidery to provide a distinctive look and feel. As with the mini-blankie of FIGS. 1 and 2, the doll head may be specially colored and scented.

An opening pull-tab in the form of a crest or mohawk crown 25 of contrasting tactile material to that of the panel 20 (e.g., satin contrasted to terry cloth) is attached to the head by a generally U-shaped line of stitching 26.

The head 11 is attached to the garment G by the collar 27 attached by adhesive or stitching 28 to the head and by stitching 29 to the open end of the pocket and to an opening in the garment G.

Figure 7:
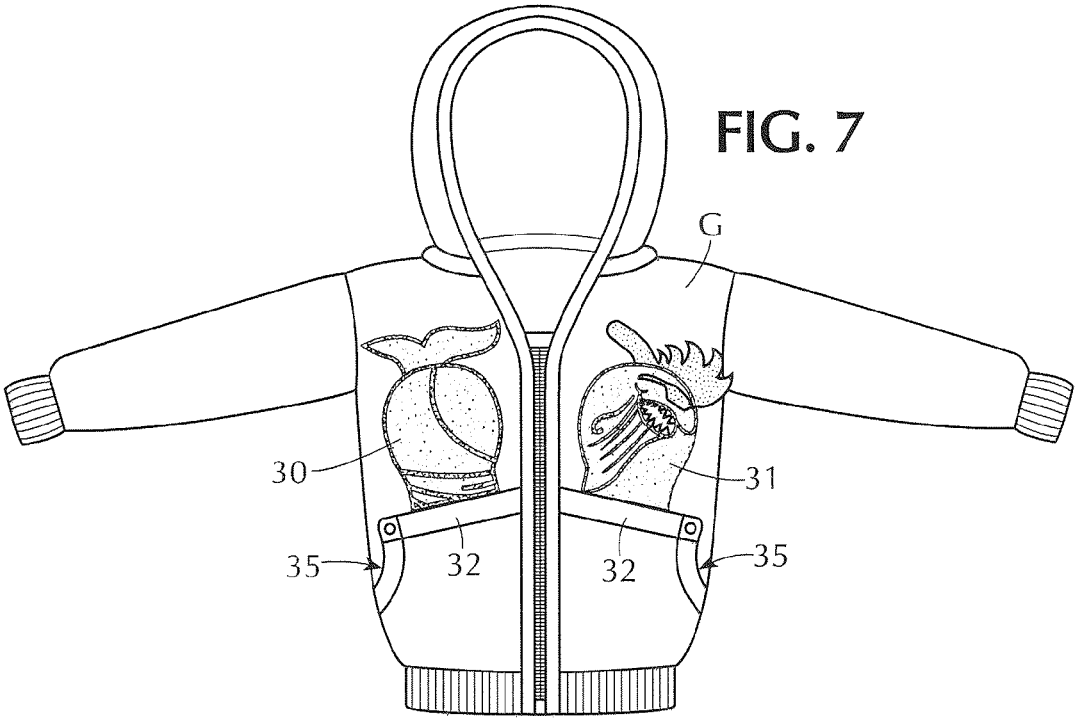
FIG. 7 is a perspective view of a sweatshirt incorporating the integral security blanket construction of the invention with third and fourth "security blankets" deployed by reversing the pockets.
Figure 8:
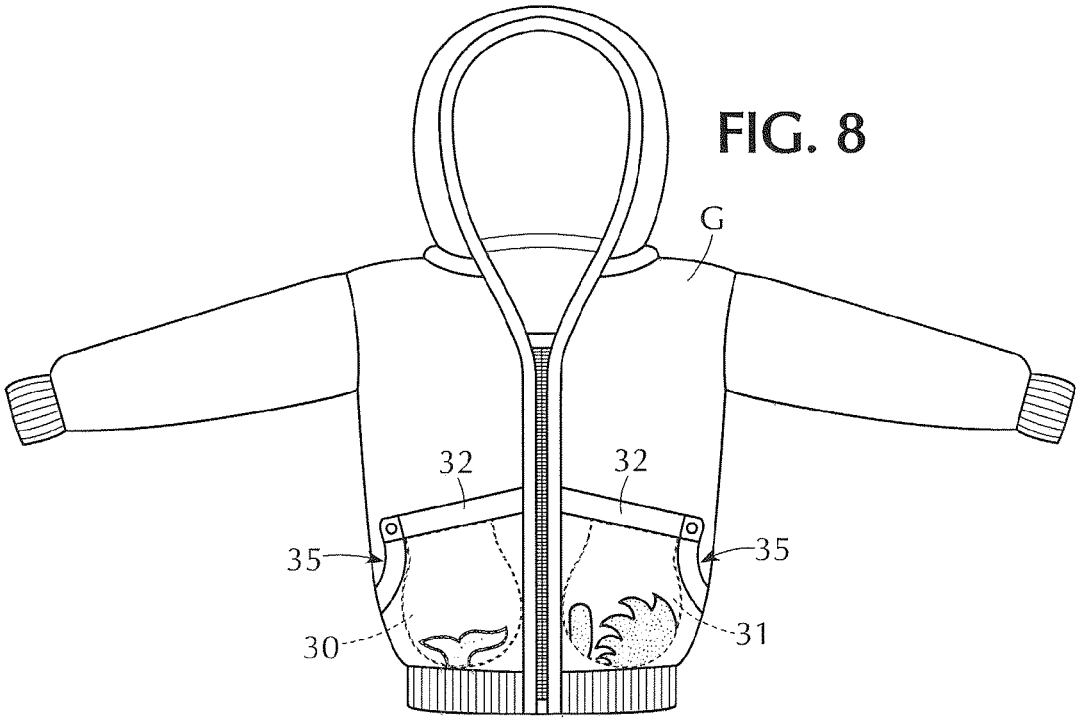
FIG. 8 is a schematic perspective view of the sweatshirt of FIG. 7 with the third and fourth pockets in non-reversed status.

Another embodiment of the invention is illustrated in FIGS. 7 and 8 where the reversed security objects 10, 11 are formed as hand puppets 30, 31 which when reversed from pocket mode of FIG. 8 to deployed mode of FIG. 7, may be accessed by hand. In accordance with the invention, the garment G is provided with a dual opening to accommodate access to the garment interior as well as access to the reversible pockets 30, 31.

Figure 9:
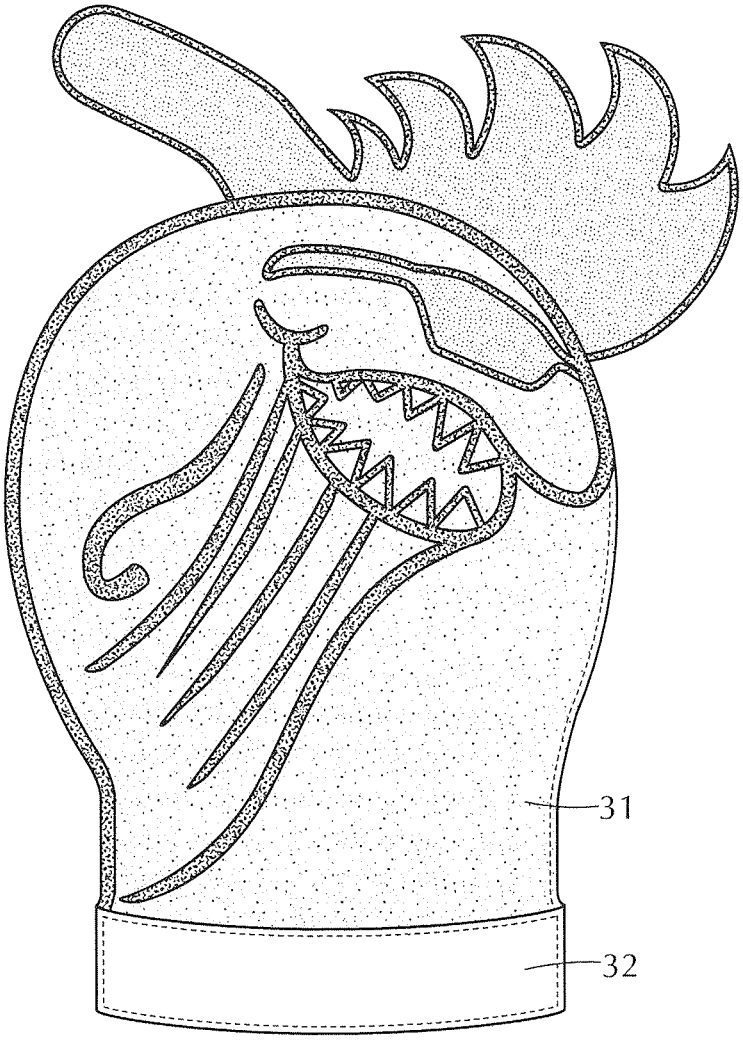
FIG. 9 is a schematic exterior view of a preferred embodiment of a third reversible security blanket pocket of the invention.
Figure 10:
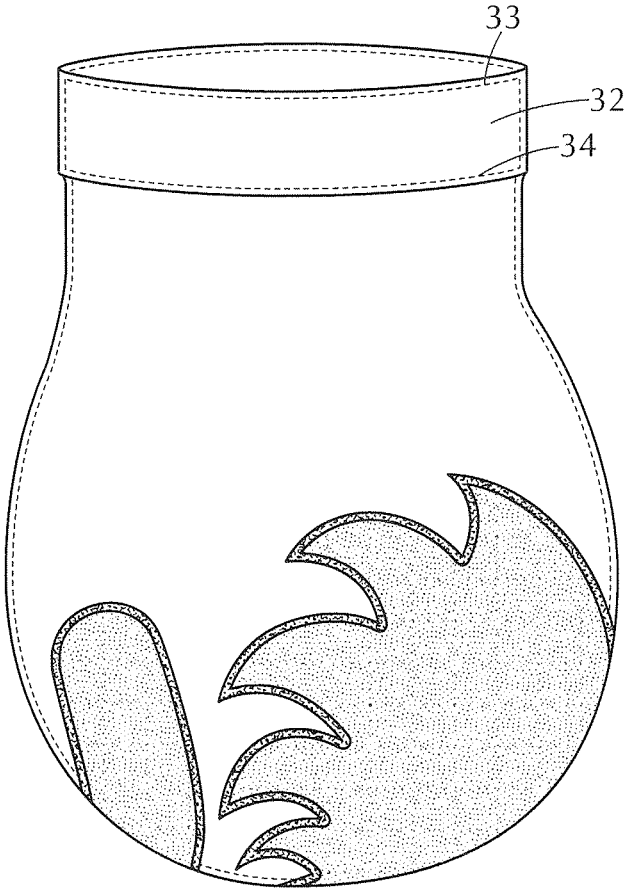
FIG. 10 is a schematic interior view of a preferred embodiment of a third reversible security blanket pocket of the invention.

Specifically, the pockets 30, 31 are formed in the manner of the previously described pockets 11, 12. They have tactile panels and contrasting pull tabs, for example, in the form of a tail fin (for a shark puppet) or mohawk crown (for a doll head puppet) as shown in FIG. 9.

As with the pockets 10, 11, the puppet pockets are attached to a pocket opening in the garment G by collar 32 and comparable stitching 33, 34. However, in accordance with the invention, the garment G is provided with an auxiliary extra opening 35 adjacent the collar 32 to provide access into the garment G and into the reversed pocket puppets 30, 31. The reversed pocket puppets, in addition to providing blankie comfort, may be readily manipulated by the insertion of the user's hand.

It will be appreciated that other types of objects than security products may be incorporated into the reversible pockets such as tactile cartoon characters, tactile college mascots, tactile corporate logos, and other specific, deployable, three-dimensional imagery.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. A garment having (a) at least one garment wall adapted to support a reversible pocket;

(b) said reversible pocket having opposed reversible pocket walls;

(c) said pocket walls secured about peripheral edges to said garment wall leaving an accessible first pocket opening;

(d) said reversible pocket walls form a hand puppet wherein at least one of said pocket walls has graphics on an interior surface of the pocket wall and is shaped to provide the appearance of a puppet when said pocket walls are reversed;

(e) said garment wall forms a second pocket opening that is linked to and contiguous with the first pocket opening, said second pocket opening being separated from the first pocket opening solely by a corner of the pocket;

(f) said second pocket opening being accessible from an exterior of the garment; and (g) said second pocket opening adapted to provide access to the interior of said hand puppet and to allow the user to reverse the pocket and deploy the hand puppet out of the first pocket opening in a reversed orientation by inserting a hand into said second pocket opening to contact the interior of said hand puppet and extending the hand through said first pocket opening.

2. The garment of claim 1, in which (a) an edge portion of said reversible pocket being graspable to reverse said pocket for deployment exteriorly of the garment wall;

(b) said edge portion is a juxtaposed strip circumscribing the pocket.

3. The garment of claim 2, in which (a) said edge portion is a discrete element having a predetermined shape extending outwardly from the pocket when deployed and extending inwardly of the pocket for ready grasping when the pocket is in its undeployed condition.

4. The garment of claim 1, in which (a) pocket walls being formed of tactile material having a comfort feel comprising a first distinctive feel in order to provide an emotional security structure;

(b) said graspable edge portion being formed of a tactile material having a second distinctive feel distinguishable by touch from that of said first distinctive feel;

(c) said tactile material being selected from terry cloth, plush, velour, satin, mohair, and cashmere.

5. The garment of claim 1, in which (a) at least one of said pocket walls includes embroidery establishing a predetermined design.

6. The garment of claim 1, in which (a) at least one of said pocket walls is impregnated with a predetermined aromatic scent.

7. A garment having (b) at least one garment wall adapted to support a reversible pocket;

(c) said reversible pocket having opposed reversible pocket walls;

(d) said pocket walls secured about peripheral edges to said garment wall leaving an accessible first pocket opening;

(d) said reversible pocket walls forming a plaything;

(e) said garment wall forms a second pocket opening that is linked to and contiguous with the first pocket opening, said second pocket opening being separated from the first pocket opening solely by a corner of the pocket;

(f) said second pocket opening being accessible from an exterior of the garment; and (g) said second pocket opening adapted to provide access to the interior of said reversible pocket and to allow the user to reverse the pocket and deploy the plaything out of the first pocket opening in a reversed orientation by inserting a hand into said second pocket opening to contact the interior of said plaything and extending the hand through said first pocket opening.

* * * * *